United States Patent [19]

Morgenstern et al.

[11] Patent Number: 4,722,569

[45] **Date of Patent: * Feb. 2, 1988**

[54] POWER AND MANUALLY ACTUATED LUMBOSACRAL BACKREST

[75] Inventors: Robin L. Morgenstern, 1443 N. Dearborn St., Chicago, Ill. 60610; Edward W. Osann, Jr., Chesterton, Ind.

[73] Assignee: Robin L. Morgenstern, Chicago, Ill.

[ * ] Notice: The portion of the term of this patent subsequent to Sep. 17, 2002 has been disclaimed.

[21] Appl. No.: 824,078

[22] Filed: Jan. 30, 1986

Related U.S. Application Data

[63] Continuation-in-part of Ser. No. 775,589, Sep. 13, 1985, abandoned.

[51] Int. Cl.[4] ..... A47C 3/00

[52] U.S. Cl. ..... 297/284; 297/460

[58] Field of Search ..... 297/284, 460, 337, 339

[56] References Cited

U.S. PATENT DOCUMENTS

| | | | |
|---|---|---|---|
| 2,049,550 | 8/1936 | Van Dresser et al. | 297/284 |
| 3,196,868 | 7/1965 | Johnston | 297/284 |
| 3,250,569 | 5/1966 | Gaffney | 297/339 |
| 3,642,319 | 2/1972 | Berchicci | 297/284 |
| 4,465,317 | 8/1984 | Schwarz | 297/284 |
| 4,541,670 | 9/1985 | Morgenstern et al. | 297/284 |

*Primary Examiner*—Francis K. Zugel

*Attorney, Agent, or Firm*—Edward W. Osann, Jr.

[57] ABSTRACT

An improved lumbosacral backrest having a back engaging contour which is adjustable under power or manual operation to accommodate users' backs which vary widely in configuration and dimension. It has a contour defined by a segmented regulator spindle inserted between a foundation frame and resilient back support, the regulator spindle being adjustable along the back support and adapted to define a transverse plane of rigidity at the proper level and shape to provide comfortable support for the individual user's back.

The backrest includes appropriate power means for actuating the regulator spindle to effect massaging action on the lumbosacral region of the back.

It further includes manual means for adjusting the regulator spindle and which is operable when the power means for effecting massaging action has been deenergized.

23 Claims, 26 Drawing Figures

FIG. 1
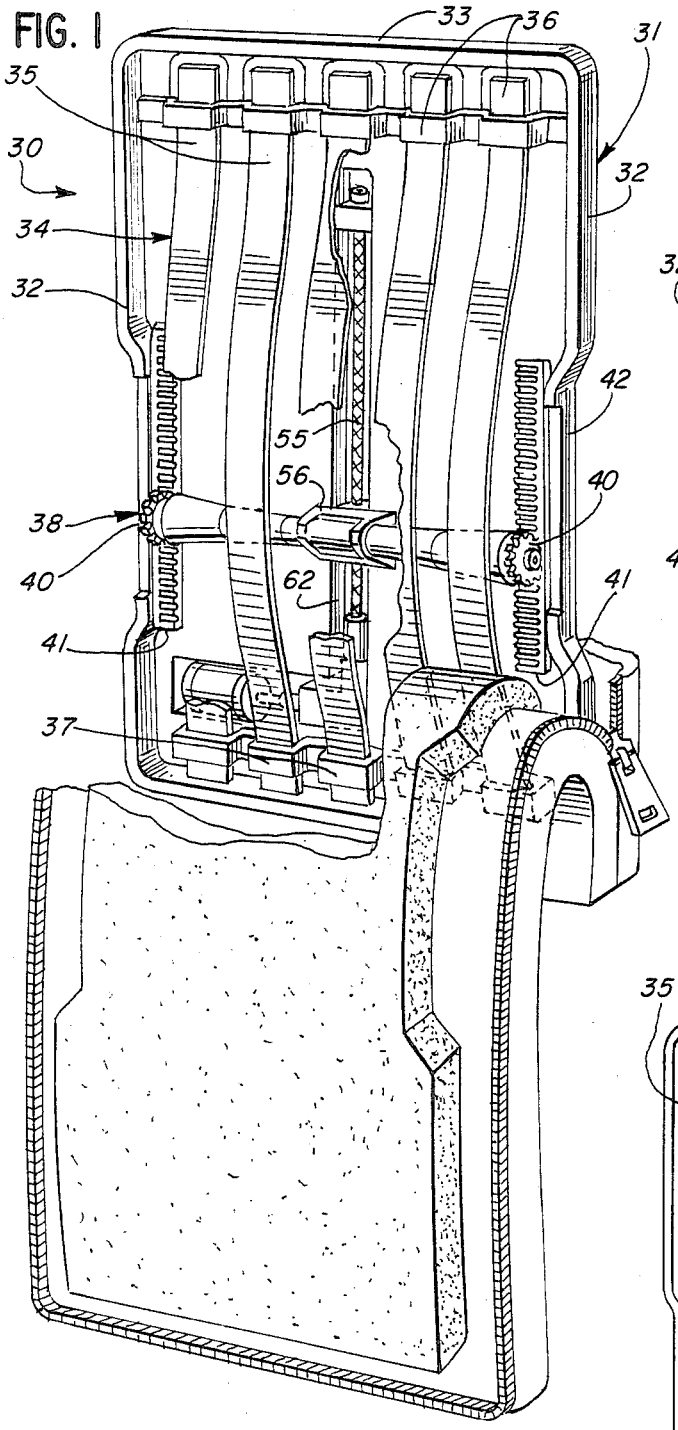
FIG. 2
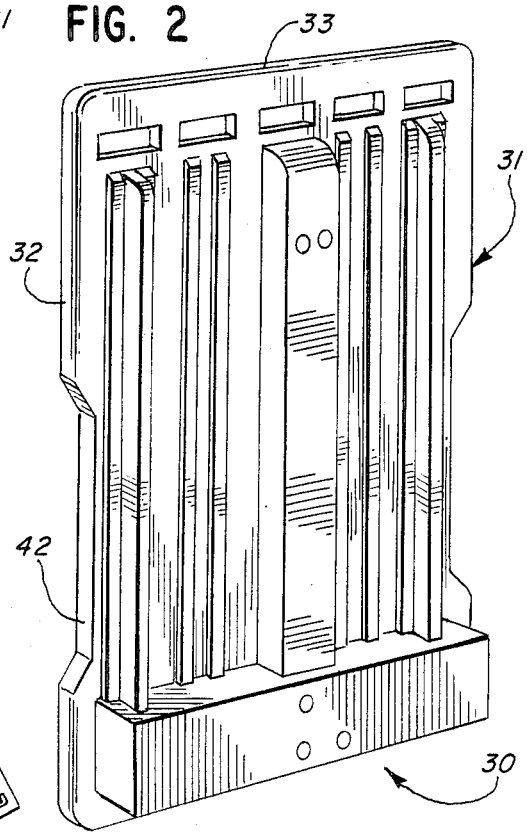
FIG. 4
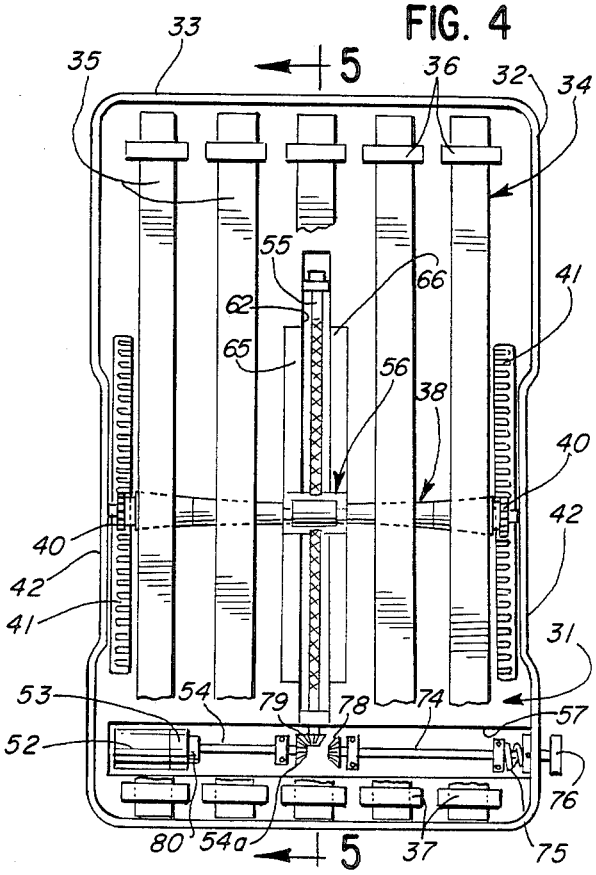
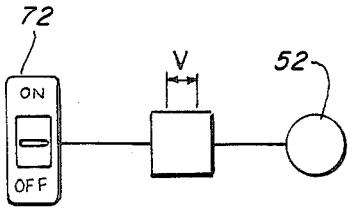
FIG. 3

FIG. 5
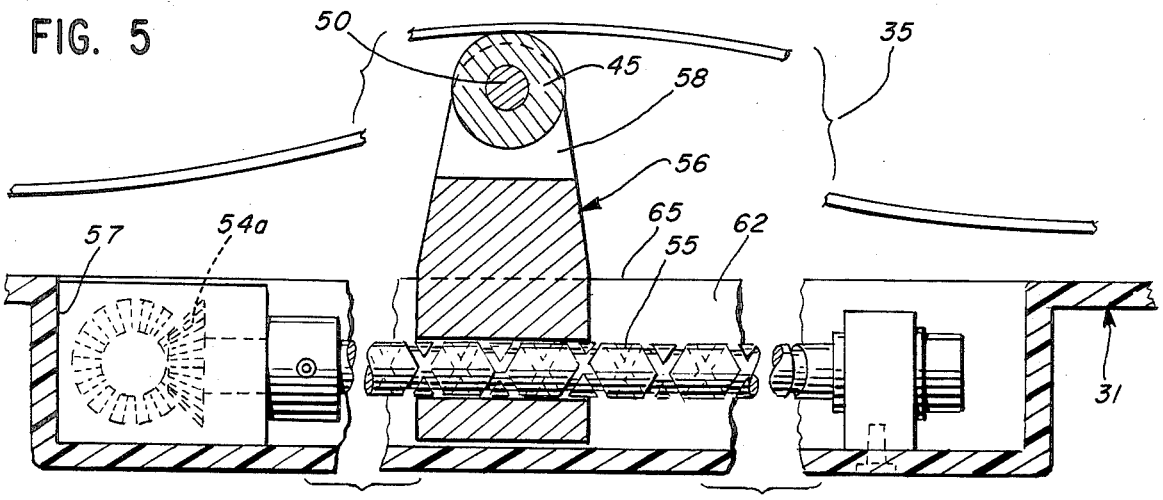
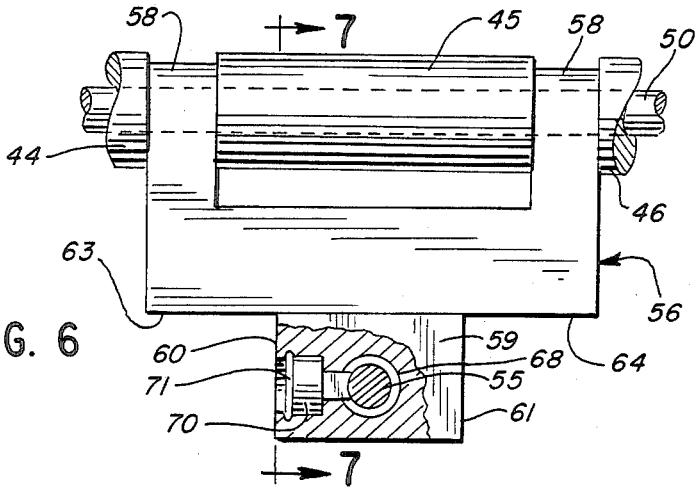
FIG. 6
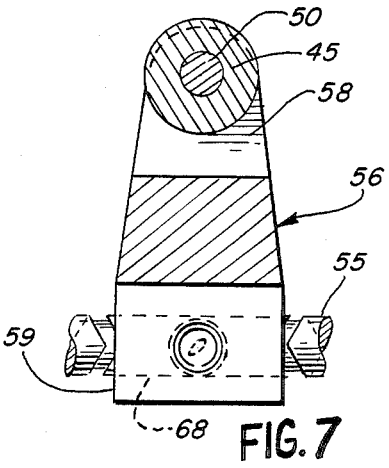
FIG. 7
FIG. 8
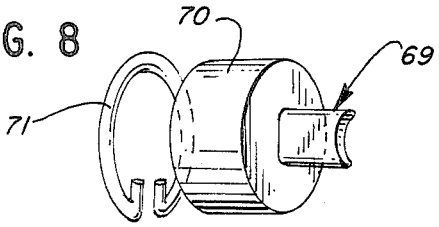
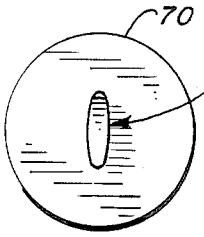
FIG. 9
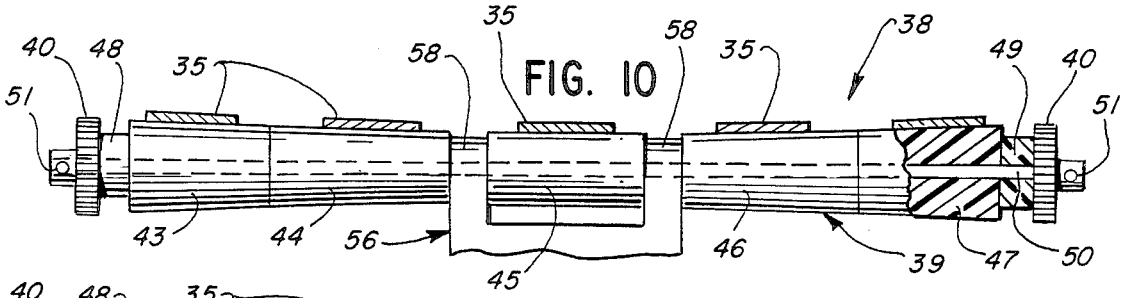
FIG. 10
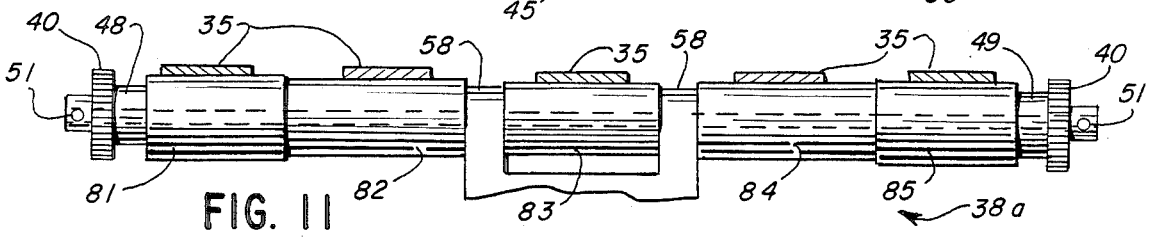
FIG. 11

FIG. 15
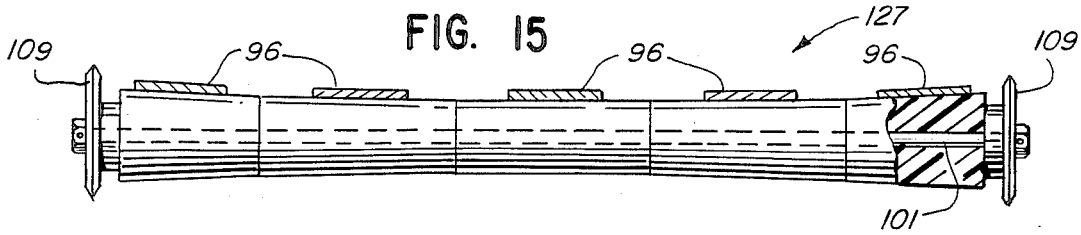
FIG. 16
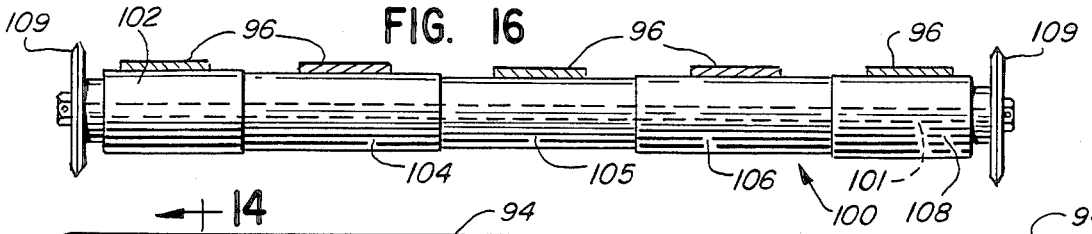
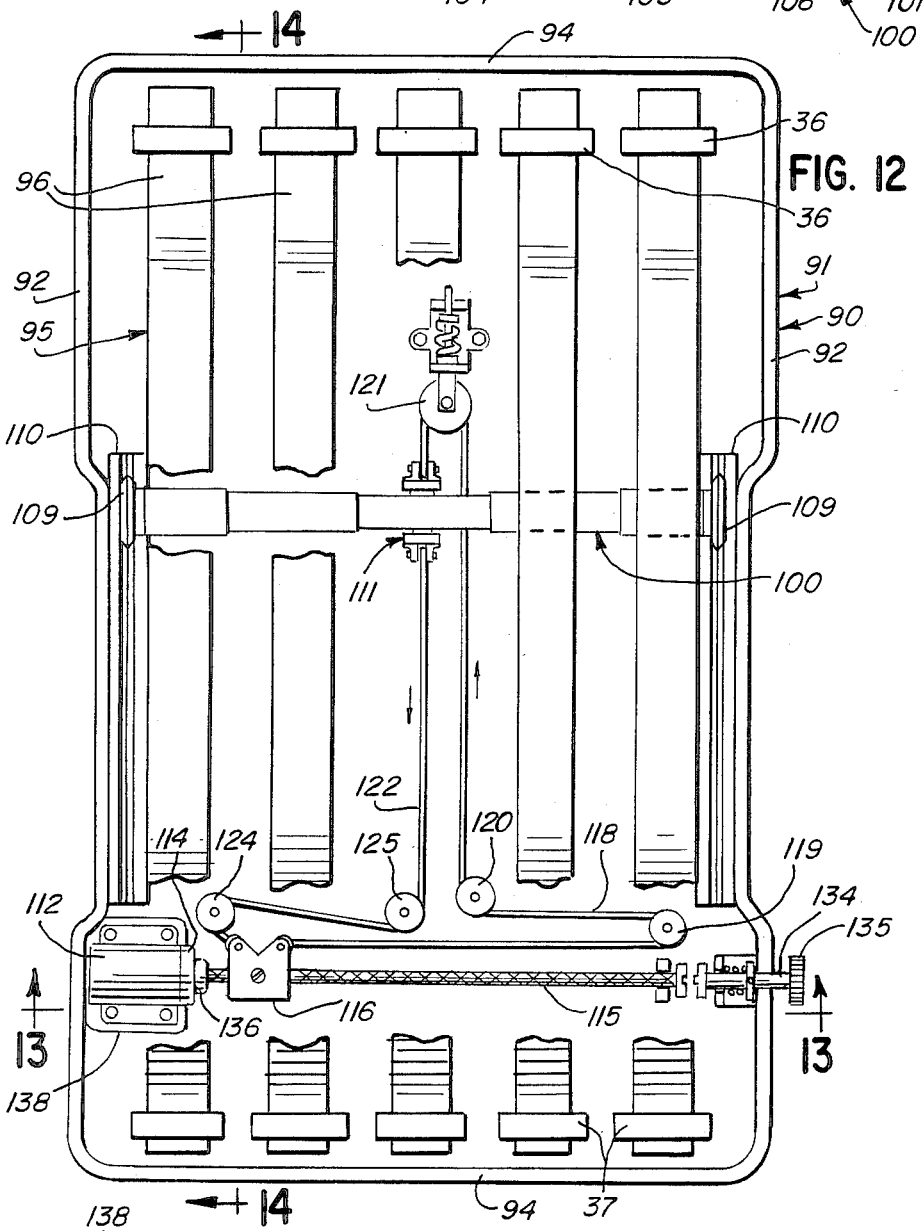
FIG. 12
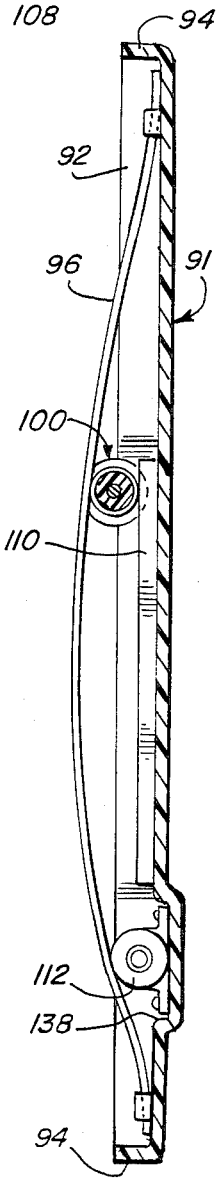
FIG. 14
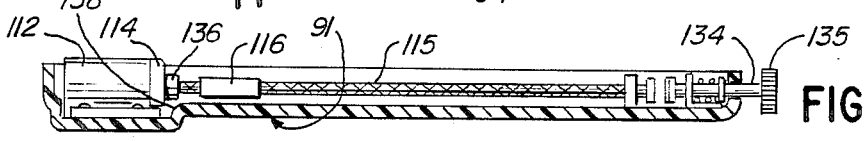
FIG. 13

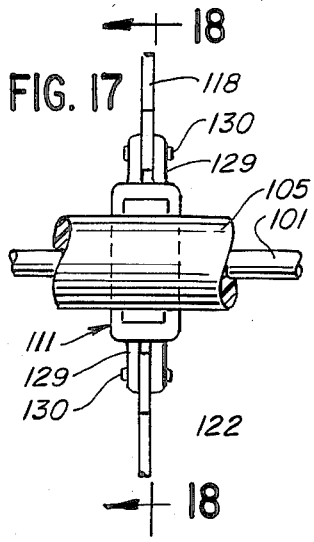
FIG. 17
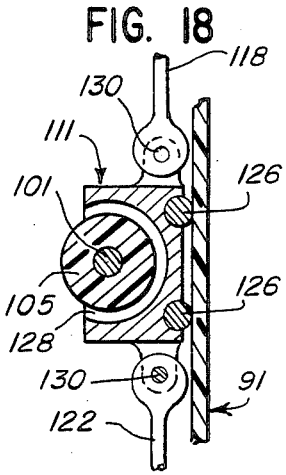
FIG. 18
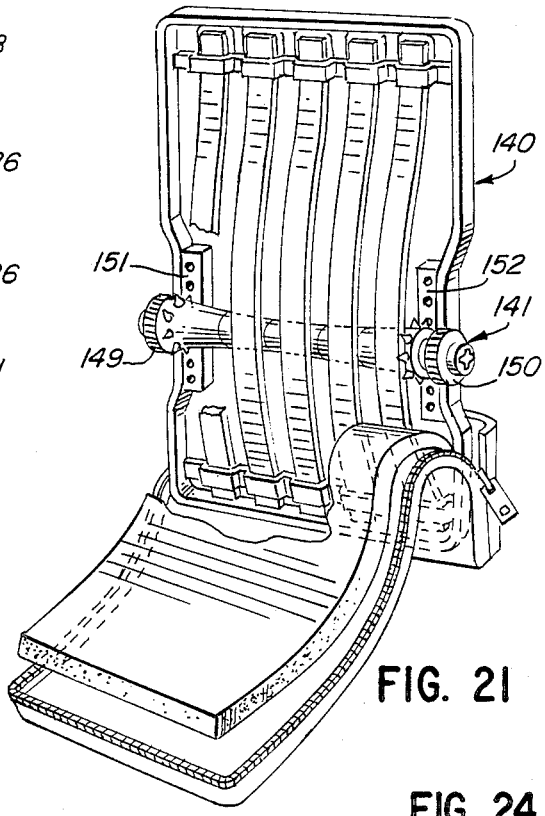
FIG. 21
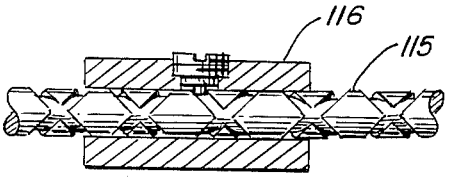
FIG. 19
FIG. 20
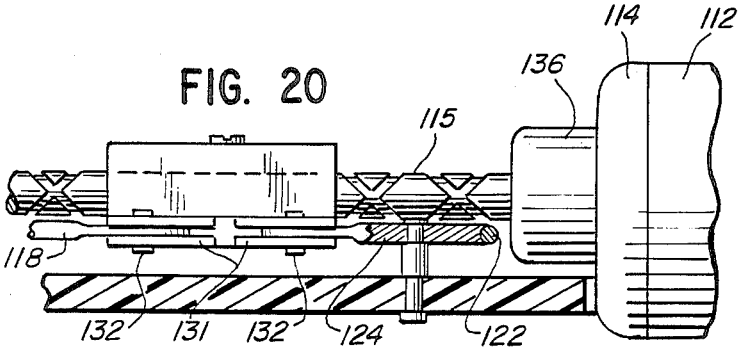
FIG. 24
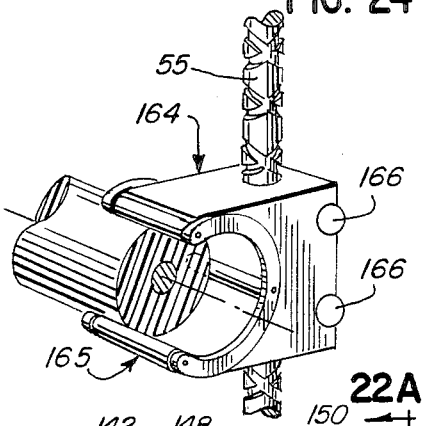
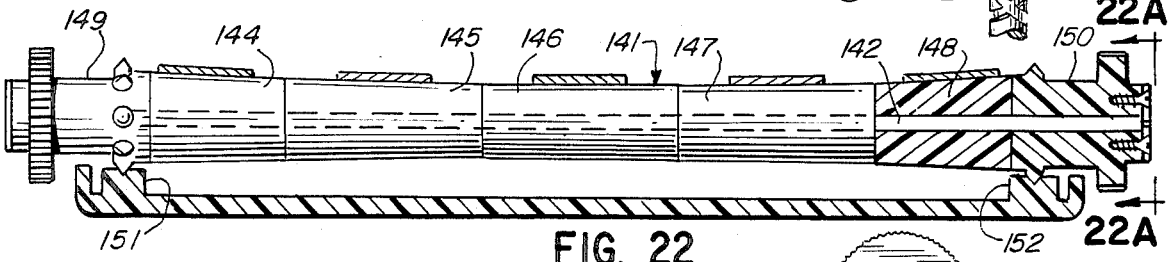
FIG. 22
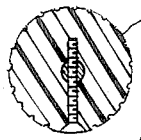
FIG. 23A
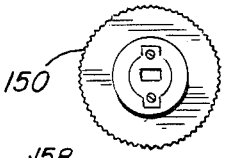
FIG. 22A
FIG. 23
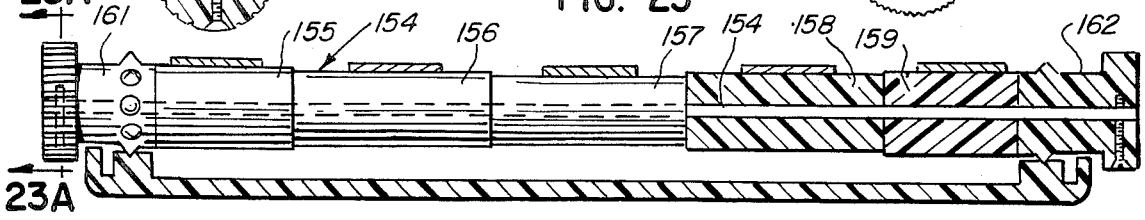

POWER AND MANUALLY ACTUATED LUMBOSACRAL BACKREST

The present application is a continuation-in-part of our prior copending U.S. application Ser. No. 775,589, filed Sept. 13, 1985 and now abandoned.

The present invention relates to portable backrests for use with chairs, beds and other furniture, vehicle seats and wheelchairs. More specifically, the invention relates to a portable backrest of this nature having novel power driven or manual means for adjusting its support contour to accommodate individual users with backs of various physical dimensions.

This invention represents an improvement over the devices disclosed in our prior U.S. application Ser. No. 523,660, now U.S. Pat. No. 4,541,670.

BACKGROUND OF THE INVENTION

The field of backrests has been the subject of developmental efforts for many years. This is due largely to the fact that back pain and back disorders afflict a major segment of the population. For a number of reasons such as bad posture, poor sitting habits, or poor physical condition, the natural elongated S-shape of the spinal column may become distorted. A well constructed backrest, properly adjusted, tends to restore the spinal S-curve to proper configuration and thereby relieves or avoids the uneven pressures on discs and vertebrae which cause troublesome pain and fatigue.

The following prior art patents disclose a variety of backrests, some of which are portable and others of which are built into chairs or vehicle seats: U.S. Pat. Nos. 2,756,809—Endresen; 2,843,195—Barvaeus; 2,894,565—Conner; 3,642,319—Berchicci; 3,663,055—Gale; 3,762,769—Poschl; 3,990,742—Glass et al.; 4,350,338—Weiner; 4,239,282—White; 3,890,000—Easley; 4,465,317—Schwartz; and French patent No. 1,182,558—Fader.

SUMMARY OF THE INVENTION

One object of the present invention is to provide an improved lumbosacral backrest having a back engaging contour which is adjustable under power or manual operation to accommodate users' backs which vary widely in configuration and dimension.

Another object is to provide a backrest of the foregoing type which may be adjusted quickly and easily while in position behind the user. Such adjustment may be effected manually or by power.

A further object is to provide a backrest of the character set forth above with a contour defined by a regulator spindle inserted between a foundation frame and resilient back support, the regulator spindle being adjustable along the back support and adapted to define a transverse plane of rigidity at the proper level and shape to provide comfortable support for the individual user's back.

Another object is to provide a backrest of the character set forth above which includes appropriate power means for actuating the regulator spindle to effect massaging action on the lumbosacral region of the back.

A further object is to provide a backrest of the foregoing type having manual means for adjusting the regulator spindle and which is operable when the power means for effecting massaging action has been deenergized.

Still another object of the invention is to provide a backrest of the character set forth above which will be of simple, rugged construction, economical to manufacture, and require little if any maintenance.

The foregoing is accomplished by use of a segmented regulator spindle interposed between the foundation frame and the resilient bowed back support in front of same, the regulator spindle being rotatably adjustable longitudinally of the back support and thereby defining a transverse plane of rigidity across the back support at any selected position of adjustment.

The segments of the spindle are journaled on a support shaft so that they roll freely on the undersides of the bowed bands of the back support in a direction opposite to the longitudinal bodily motion of the spindle as a whole. The regulator spindle may be adjusted either manually or by power means. It may also be traversed by power means in cyclical fashion for back massage.

Other objects and advantages of the invention will become apparent from the following description and the accompanying drawings.

BRIEF DESCRIPTION OF THE DRAWINGS

FIG. 1 is a perspective view of an illustrative, portable, power operated backrest embodying the present invention, with the cover opened to show internal structure.

FIG. 2 is a perspective view, slightly reduced, of the rear face of the backrest shown in FIG. 1 with the cover removed.

FIG. 3 is a diagrammatic view of a control circuit for the backrest adjusting means of FIGS. 1, 2 and 4–11 showing an enlarged elevational view of the control switch.

FIG. 4 is a fragmentary plan view illustrating the backrest of FIG. 1 with certain parts broken away to show internal structure.

FIG. 5 is an enlarged, broken longitudinal sectional view through the power drive mechanism associated with the regulator spindle, taken in the plane of the line 5—5 in FIG. 2.

FIGS. 6 and 7 are enlarged elevational views, partially in section, taken in the planes of the lines 6—6 and 7—7 in FIGS. 5 and 6, respectively, detailing the follower key and its engagement with the dual threaded drive shaft of the regulator spindle.

FIGS. 8 and 9 are additional enlarged views, the first in perspective and the second in elevation, further detailing the follower key.

FIG. 10 is an enlarged elevational view, partially in section, showing the tapered and segmented regulator spindle of the backrest illustrated in FIGS. 1, 2 and 4–7.

FIG. 11 is a view similar to FIG. 10 but showing a modified form of regulator spindle having stepped segments of different diameter.

FIG. 12 is a fragmentary plan view of a modified form of power actuated backrest also embodying the present invention.

FIGS. 13 and 14 are vertical sectional views through the backrest of FIG. 12 taken in the planes of the lines 13—13 and 14—14, respectively.

FIG. 15 is an enlarged elevational view similar to FIG. 10 but showing a modified regulator spindle with V-flange guide wheels rather than gears.

FIG. 16 is an enlarged elevational view detailing a further modified regulator spindle like the one shown in FIG. 12 having stepped segments of different diameters.

FIG. 17 is an enlarged fragmentary plan view of the drive block for the regulator spindle in the backrest shown in FIG. 12.

FIG. 18 is a longitudinal sectional view through the drive block and spindle taken in the plane of the line 18—18 in FIG. 17.

FIG. 19 is an enlarged, fragmentary vertical sectional view through the auxiliary drive block shown in FIG. 20.

FIG. 20 is an enlarged, fragmentary elevational view, partially in section, taken in the plane of the line 20—20 in FIG. 12.

FIG. 21 is a perspective view of a lumbosacral backrest of the general type shown in FIGS. 1 and 12 but having a manually adjusted rack and pinion regulator spindle and embodying the present invention.

FIG. 22 is an enlarged elevational view, partly in section, of the manually actuated rack and pinion regulator spindle for the backrest shown in FIG. 21.

FIG. 22A is an end view of the regulator spindle shown in FIG. 22.

FIG. 23 is a view similar to FIG. 22 but showing a modified form of manually actuated regulator spindle having stepped segments of different diameters.

FIG. 23A is a transverse sectional view through one of the adjusting knobs of the spindle shown in FIG. 23.

FIG. 24 is an enlarged, fragmentary perspective view detailing a modified form of drive block adapted for use in the backrest of FIG. 1.

While the present invention is susceptible of various modifications and alternative constructions, there is no intention to limit the invention to the specific forms illustrated and described herein. On the contrary, the intention is to cover all modifications and alternative constructions falling within the spirit and scope of the invention as set forth in the appended claims.

DETAILED DESCRIPTION OF THE INVENTION

The present invention resides in certain improvements over the backrests disclosed and claimed in said prior application Ser. No. 523,660, now U.S. Pat. No. 4,541,670. All such backrests, both those of U.S. Pat. No. 4,541,670 and those of the present application, have certain features in common which should be noted prior to describing the improvements.

Referring more specifically to FIGS. 1, 2, 4, 12 and 21, it will be apparent that each such figure shows a lumbosacral backrest comprising a foundation frame of high strength plastic or light metal. The frame has an out-turned peripheral margin with slightly indented areas in its two longer sides. It carries a flexible back support comprising a series of laterally spaced bands of spring steel or other resilient material secured to the frame by brackets in an outwardly bowed configuration. A regulator spindle is interposed between the foundation frame and the bands of the back support, serving as a contour adjusting means. A pad of resilient material is placed over the back support and held in position by a strong fabric cover C.

Turning now to embodiment of the lumbosacral backrest 30 illustrated in FIGS. 1–11, the contour of the latter may be adjusted by power or by manual means. The backrest 30 comprises an upstanding foundation frame 31 of generally rectangular form with stiffening ribs (not shown) and an out-turned peripheral margin including side portions 32 and end portions 33. The flexible back support 34 is defined by a series of laterally spaced steel bands 35 of spring steel or other resilient material of greater length than the foundation frame 31, thereby giving the support 34 a resilient, outwardly bowed configuration. The upper end portions of the bands 35 are held in place by overlying brackets 36 and the lower end portions are held in place by overlying brackets 37. The brackets 36 are spaced below the upper out-turned margin 33 of the frame by an amount which is at least equal to the width of an individual band. This tends to create a moderate biasing force urging the bands 35 against the frame 31 and thus tending to shift the apex of their curvature to a point slightly below the horizontal center line of the frame.

A contour adjusting means in the form of a regulator spindle 38 is interposed between the bowed spring bands 35 of the back support and the foundation frame 31 to adjust the contour of the yieldable back support 34 longitudinally and transversely thereof (FIGS. 1, 4–7, 10, 11). The regulator spindle 38 in this instance comprises a body 39 of circular cross-section and an axial section of double concave form. Thus the body has a minimum diameter at its center, tapering gently outward to a larger diameter adjacent each of its ends. This disposes the yieldable support bands 35 in a concave orientation longitudinally of the spindle 38 and thereby provides a transverse plane of rigidity across the back support 34.

The spindle 38 is adapted to traverse the medial portion of the foundation frame 31 by power or manual means in the course of adjusting the contour of the back support. The spindle is accordingly formed with a gear wheel flange 40 adjacent each end thereof. Each gear wheel flange 40 is adapted to mesh with a guideway, in the form of a rack 41 integral with, or fixed to, the foundation frame 31. The racks 41 are generally parallel with the long dimension of the foundation frame 31 and are situated inboard of the indented portions 42 of the out-turned sides. The resilient bands 35 of the yieldable support member 34 bear against the peripheral surface of the regulator spindle 38. This maintains engagement between the gear wheel flanges 40 and the guide racks 41 and between the adjacent peripheral areas of the spindle 38 and the bottom surfaces of the resilient bands 35. Stop abutments (not shown) may be situated at the end of the respective guide racks 41 to prevent overtravel of the spindle.

In accordance with the present invention, provision is made for dramatically reducing friction between the regulator spindle 38 and the overlying steel bands 35 of the back support as the spindle traverses the guide racks 41. Referring more specifically to FIGS. 1, 4, 10 and 11, it will be noted that this is accomplished by dividing the spindle body 39 into segments 43, 44, 45, 46 47, one for each band 35, and a pair of short segments 48, 49 integral with the respective gear wheel flanges 40. In addition, each segment is formed with an axial bore and journaled on a common support shaft 50, the end portions of which are rigidly fixed to the gear wheel flanges 40. The latter may be secured in place as by suitable locking pins or set screws 51.

With the regulator spindle 38 constructed as described above, when the spindle is moved along the guideways 41, the spindle segments 43–47 will roll freely on the undersides of the bands 35 in a direction opposite to the bodily motion of the spindle 38 as a whole. This drastically reduces the frictional force opposing the spindle motion and thereby reduces the force required to move the spindle along the guideways 41.

Conversely, with a solid bodied regulator spindle, the spindle is rolling forward in the same direction as its bodily motion, creating excessive friction against the underside of the bands 35 and requiring excessive force to move the spindle along the guideways. This, in turn, requires a substantially larger drive motor and greater electric power to move the solid bodied spindle than in the case of the segmented spindle.

Power is transmitted to the regulator spindle 38 for traversing it along the guideways 41 by means of a drive train (FIGS. 1, 4–7, 10). The latter in this case comprises a unidirectional electric motor 52, reduction gear 53, cross shaft 54, and bevel gear set 54*a*, all recessed within a trough 57 running transversely of the foundation frame 31. The drive train further includes dual threaded shaft 55, and drive block 56, operating in a large central guide trough 62 running longitudinally of the foundation frame. The drive block is formed with a pair of upstanding arms 58 straddling the medial segment 45 of the regulator spindle. The support shaft 50 of the spindle is journaled in the upper portion of the arms 58. The latter have curved upper surfaces recessed slightly below the peripheral surfaces of the medial roller segment 45 and adjacent segments 44, 46.

The drive block 46 has a depending extension 59 (FIGS. 5–7) with opposed sides 60, 61 which slidably engage the large central guide trough 62 formed in the foundation frame 31. The extension 59 is flanked by a pair of bearing surfaces 63, 64 on the underside of the guide block and which slidably engage mating bearing surfaces 65, 66 on either side of the guide trough 62. The guide block extension 59 has a central bore 68 which slidably receives the dual threaded shaft 55. A drive key 69, fixed to a pivotable support head 70 establishes the drive connection between the shaft 55 and the drive block 56 via the extension 59 (FIGS. 4, 5–9). The drive key 69 is housed in a suitable bore in the extension 59 and retained in place as by means of snap ring 71.

By use of the control switch 72 and circuit indicated in FIG. 3, the spindle 38 may be driven by dual threaded shaft 55 and drive block 56 to any desired position of adjustment and stopped there by turning the switch to "Off" position. On the other hand, if the unit is to be used for back massage, the switch may be left in the "On" position and the dual threaded shaft will cause the regulator spindle 38 to reciprocate and thereby reciprocate the transverse plane of rigidity up and down the back support 34.

Provision is made in the backrest 30 for manually adjusting the position of the regulator spindle in the event electric power is not readily available. This is accomplished in the present instance by means of a spring biased manual adjusting shaft 74 aligned with the motor shaft 54. The shaft 74 is held in normally disengaged position by biasing spring 75. To engage the adjusting shaft 74 with the dual threaded shaft 55, the knob 76 of the adjusting shaft is pushed inwardly and turned slightly until its bevel gear 78 meshes with the bevel gear 79 on the dual threaded shaft 55. By reason of overrunning clutch 80 between the reduction gear 53 and the motor shaft 54, the manual adjusting shaft may be freely turned to position the regulator spindle manually without interference from the drive motor 52.

In further accordance with the invention, a modified form of regulator spindle 38*a*, shown in FIG. 11, may be provided for use in the backrest 30. The spindle 38*a* is similar in construction to the spindle 38 in that both are segmented in a similar manner. The spindle 38*a*, however, utilizes stepped segments 81, 82, 83, 84, 85 of different diameters rather than individually tapered segments. It uses a support shaft 50 identical to that of the spindle 38 rigidly fixed at its ends to gear wheel flanges 40 identical to those of spindle 38. As in the case of the spindle 38, the stepped segments of the spindle 38*a*, along with the resilient pad, provide a highly satisfactory concave orientation for the transverse plane of rigidity across the back support.

Referring next to FIGS. 12–20, a modified form of backrest 90 is there shown also embodying the invention. As pointed out earlier herein, the backrest 90 is generally similar to the backrest 30 in that the backrest 90 utilizes a similar foundation frame 91 with out-turned peripheral margins 92, 94, slightly indented areas on the two longer sides, a similar flexible back support including flexible steel bands 96 covered by a resilient pad 98, a regulator spindle driven by power or manually positioned, and a fabric cover 99. The flexible bands 96 are held adjacent their ends by upper and lower brackets 36, 37 identical to those of the backrest 30.

The backrest 90 utilizes a minimal friction regulator spindle 100 of the stepped segment type, shown in FIGS. 12 and 16. The spindle 100 includes a support shaft 101 running centrally through the segments 102, 104, 105, 106, 108 and rigidly fixed at its ends to wheel flanges 109. The flanges 109 engage V-grooves in a pair of guideways 110 generally parallel with the long dimension of the foundation frame and situated inboard of the indented portions of the out-turned sides. The spindle 100 defines a transverse plane of rigidity across the back support 95 which may be traversed upwardly or downwardly of the foundation frame 91 by power or manual means actuating a main drive block 111.

In accordance with a further aspect of the invention, the spindle 100 may be traversed along the guideways 110 by a drive train comprising unidirectional motor 112, reduction gear 114, dual threaded drive shaft 115 running laterally of the foundation frame 91, auxiliary drive block 116 keyed to the shaft 115, and a connecting cable system. The latter comprises a first reach of cable 118 connected to the right hand end of the auxiliary drive block 116, thence around fixed guide sheaves 119, 120 journaled on the foundation frame, thence around resiliantly biased take-up sheave 121 also mounted on the foundation frame, and thence connected to the upper end of the drive block 111. The cable system also includes a second reach of cable 122 connected to the left hand end of the auxiliary drive block 116, around fixed guide sheaves 124, 125 journaled on the frame 91, and thence connected to the lower end of the drive block 116.

It will be apparent from the foregoing that upon energizing the unidirectional drive motor 112, the auxiliary drive block 116 will be reciprocated longitudinally of the dual threaded drive shaft 115. This reciprocating movement will be transferred to the main drive block 111 by the cables 118, 122, traversing the spindle 100 back and forth along the guideways 110. By means of a control switch 72 and circuit such as shown in FIG. 3, the spindle 100 may be stopped at any desired point in its travel or be permitted to reciprocate for massaging action.

The main drive block 111 (FIGS. 17, 18) in the present instance is provided with rollers 126 to minimize the force required to traverse it along the foundation frame 91. For the same objective, the block 111 is provided with a truncated sleeve bearing 128 to rotatably support the medial roller 105 of the regulator spindle 100. The block 111 is also formed with a pair of clevises 129 and pins 130 which connect the cables 118, 122 to the block.

The auxiliary drive block 116 (FIGS. 12, 19, 20) is also formed with a pair of clevises 131 and pins 132 for connecting the cables 118, 122 to the block 116. The auxiliary drive block 116 is maintained clear of the foundation frame 91 by the fixed cable guide sheaves 119, 120, 124, 125. The block 116 is connected to the shaft 115 by means of a drive key similar to the key 69 described earlier herein.

The segmented regulator spindle 127 shown in FIG. 15 is of circular cross section and double concave form in longitudinal section. It may readily be used in the backrest 90 interchangeably with the stepped segment spindle 100 shown in FIG. 12.

The regulator spindle 100 or 127 of backrest 90 may also be manually positioned along the guideways 110 in a manner similar to that described above for the backrest 30. In this instance, a spring biased manual adjusting shaft 134 may be engaged with the right hand end of the dual threaded drive shaft 115 by pushing the knob 135 and shaft 134 to the left. With the drive motor disconnected by overrunning clutch 136, the spindle 100 or 127 may readily be positioned by turning the knob 135. In order to facilitate alignment of the adjusting shaft 134, dual threaded shaft 115, and the drive motor 112, the latter may be mounted in a recess 138 formed in the foundation frame 91.

FIG. 21 shows a manually actuated backrest 140 bearing general similarity to the backrests 30 and 90 described above except for its manual adjusting means comprising a rack and pinion structure. The backrest 140 utilizes a segmented regulator spindle 141 of double concave or tapered form corresponding to that shown in FIG. 22. The spindle 141 has a common support shaft 142 journaling the tapered segments 144, 145, 146, 147, 148. The shaft 142 is rigidly fixed at its ends to the unitary pinion and knob segments 149, 150 used for adjusting the spindle 141 along the guide rack members 151, 152. Thus rotating either end segment 149 or 150 will rotate the entire spindle.

FIG. 22 discloses a stepped segment type regulator spindle 154 generally similar to that of FIG. 16 but equipped for rack and pinion adjustment in the manually actuated backrest of FIG. 21. The spindle 154 comprises stepped cylindrical segments 155, 156, 157, 158, 159 journaled on a common support shaft 160. As in the case of spindle 141, the shaft 160 is fixed at its ends to the unitary pinion and knob segments 161, 162 used for manual adjustment of the spindle 154 along guide rack members 151, 152.

FIG. 24 discloses a modified type of drive block 164 adapted for use in a backrest such as that shown in FIG. 1. The block 164 includes a roller bearing assembly 165 having rollers 166 which engage the medial segment 45 of the regulator spindle 38. It may also include additional rollers 168 which bear against the face of the foundation frame 31 to minimize friction.

While the reciprocating drive for the regulator spindles disclosed herein utilizes the double threaded shaft keyed to a drive block, it should be borne in mind that other forms of reciprocating drive may also be used. Such an alternate arrangement might, for example, utilize a conventional screw threaded shaft engaging a threaded bore in the drive block. Proximity limit switches and a reversing motor controller may then be used to achieve the reciprocating motion.

What is claimed is:

1. A lumbosacral backrest for use with chairs, beds, vehicle seats, and wheelchairs, comprising in combination:

(a) an upstanding foundation frame;

(b) a flexible back support fastened to said foundation frame in outwardly bowed relation therewith;

(c) a regulator spindle disposed transversely of said foundation frame and said flexible back support and interposed therebetween to define a transverse plane of rigidity across said back support;

(d) guide means adjacent the ends of said regulator spindle journaling same for rotational movement in a first direction longitudinally of said back support; and (e) means interposed between said guide means adapted to rotate relative to said back support in a direction opposite to said first direction.

2. A lumbosacral backrest as defined in claim 1, wherein said regulator spindle has a body interposed between said guide means which rotates in a direction opposite to that of said guide means when said spindle is traversed longitudinally of said back support.

3. A backrest as defined in claim 2, wherein said spindle body rotates on the underside of said back support when said spindle is traversed longitudinally thereof.

4. A lumbosacral backrest as set forth in claim 2, wherein said regulator spindle has a shaft extending through said body between said guide means.

5. A backrest as defined in claim 4, wherein said body is divided into segments between said guide means, each said segment engaging one of said resilient bands of said back support.

6. A backrest as set forth in claim 5, wherein said segmented roller body has an axial cross section of double concave form.

7. A backrest as set forth in claim 5, wherein said segmented roller body has an axial cross section of stepped form increasing progressively in diameter from its medial portion toward each guide means.

8. A backrest as defined in claim 5, wherein said shaft is positively connected at its ends to said guide means and said segments are freely journaled thereon.

9. A backrest as defined in claim 5, wherein said guide means and said segments are freely journaled on said shaft.

10. A backrest as defined in claim 1, wherein said regulator spindle is traversed longitudinally of said back support by power means.

11. A backrest as set forth in claim 1, wherein said regulator spindle is traversed longitudinally of said back support by manual means.

12. A backrest as defined in claim 1, wherein said regulator spindle is traversed longitudinally of said back support alternately by power or manual means.

13. A lumbosacral backrest for use with chairs, beds, vehicle seats, and wheelchairs, comprising in combination:

(a) an upstanding foundation frame;

(b) a flexible back support fastened to said foundation frame in outwardly bowed relation therewith;

(c) a regulator spindle disposed transversely of said foundation frame and said flexible back support and interposed therebetween to define a transverse plane of rigidity across said back support;

(d) guide means journaling said regulator spindle for rotational movement in a first direction longitudinally of said back support;

(e) body means on said spindle adapted to rotate relative to said back support in a direction opposite to said first direction; and (f) means for traversing said spindle longitudinally of said back support and thereby shifting said transverse plane of rigidity.

14. A lumbosacral backrest as defined in claim 13, wherein said guide means are situated on said foundation frame adjacent the ends of said regulator spindle.

15. A lumbosacral backrest as defined in claim 13, wherein said traversing means is power driven.

16. A lumbosacral backrest as defined in claim 15, wherein said traversing means includes a reciprocable drive block which moves said spindle bodily relative to said guide means.

17. A backrest as defined in claim 16, wherein said drive block has a rotatable connection with said regulator spindle, and said guide means comprises a pair of racks on said foundation frame together with a pair of gear wheel flanges respectively engaging said racks.

18. A backrest as defined in claim 16, and which further comprises in combination:

(a) means defining a central trough running longitudinally of said foundation frame;

(b) said trough having opposed side walls and adjacent marginal areas defining a first set of plain bearing surfaces;

(c) a depending extension formed in said drive block having opposed side walls flanked by adjacent bottom walls of said drive block, all said walls defining a second set of plain bearing surfaces engaging said first set of bearing surfaces; and (d) a power drive double threaded shaft drivingly connected to said extension of said drive block.

19. A backrest as defined in claim 18 which further comprises, in combination:

(a) a drive motor;

(b) a motor shaft;

(c) an overrunning clutch interposed between said drive motor and said motor shaft;

(d) a gear connection between said motor shaft and said double threaded shaft;

(e) a manually actuated adjusting shaft biased in normally disengaged condition with respect to said gear connection; and (f) an actuating knob on said adjusting shaft for overcoming said bias and engaging said adjusting shaft with said gear connection to shift said regulator spindle longitudinally of said foundation frame.

20. A lumbosacral backrest as defined in claim 16, wherein said regulator spindle has a plurality of segments journaled on a common support shaft, and said drive block includes a pair of upstanding arms straddling a segment of said regulator spindle, and said arms journaling said common support shaft to apply driving force to said spindle.

21. A lumbosacral backrest for use with chairs, beds, vehicle seats, and wheelchairs, comprising in combination:

(a) an upstanding foundation frame;

(b) a flexible back support fastened to said foundation frame in outwardly bowed relation therewith;

(c) a regulator spindle disposed transversely of said foundation frame and said flexible back support and interposed therebetween to define a transverse plane of rigidity across said back support;

(d) guide means journaling said regulator spindle for rotational movement in a first direction longitudinally of said back support;

(e) body means on said spindle adapted to rotate relative to said back support in a direction opposite to said first direction;

(f) a main drive block having a rotatable connection with said regulator spindle;

(g) an auxiliary drive block mounted for reciprocation by a power means; and (h) cable connections between said auxiliary drive block and said main drive block for moving the latter in response to movement of said auxiliary drive block.

22. A lumbosacral backrest as set forth in claim 21, and which further comprises, in combination:

(a) power means in the form of a drive motor;

(b) a double threaded drive shaft disposes transversely of said foundation frame and connected to said drive motor; and (c) said auxiliary drive block being mounted on said drive shaft and keyed thereto for reciprocation thereon.

23. A backrest as defined in claim 22 which further comprises, in combination:

(a) an overruning clutch interposed between said drive shaft and said drive motor;

(b) a first coupling element on the end of said drive shaft remove from said motor;

(c) a manually actuated adjusting shaft biased in normally disengaged condition having a second coupling element complimented to said first coupling element; and (d) an actuating knob on said adjusting shaft for overcoming said bias and engaging said adjusting shaft with said remote end of said drive shaft to shift said spindle longitudinally of said foundation frame.

* * * * *